US009978302B2

(12) United States Patent
Kim et al.

(10) Patent No.: US 9,978,302 B2
(45) Date of Patent: May 22, 2018

(54) LIQUID CRYSTAL DISPLAY

(71) Applicant: SAMSUNG DISPLAY CO., LTD., Yongin, Gyeonggi-Do (KR)

(72) Inventors: Gi Geun Kim, Seoul (KR); Hyun Sik Hwang, Hwaseong-si (KR); Won Sik Oh, Seoul (KR); Nam Gon Choi, Yongin-si (KR); Yong Jun Jang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 349 days.

(21) Appl. No.: 14/333,473

(22) Filed: Jul. 16, 2014

(65) Prior Publication Data

US 2015/0221248 A1 Aug. 6, 2015

(30) Foreign Application Priority Data

Feb. 5, 2014 (KR) ..... 10-2014-0013096

(51) Int. Cl.
*G09G 3/20* (2006.01)
*G09G 3/36* (2006.01)

(52) U.S. Cl.
CPC ..... *G09G 3/2044* (2013.01); *G09G 3/3648* (2013.01); *G09G 2320/0219* (2013.01)

(58) Field of Classification Search
CPC ..... G09G 3/2044; G09G 3/3696
See application file for complete search history.

(56) References Cited

U.S. PATENT DOCUMENTS 5,805,305 A * 9/1998 Abe ..... H04N 1/405 358/3.13
6,756,995 B2 6/2004 Thebault et al.
2001/0024199 A1* 9/2001 Hughes ..... G09G 3/3611 345/204
2004/0104873 A1* 6/2004 Kang ..... G09G 3/3688 345/87

(Continued)

FOREIGN PATENT DOCUMENTS

JP 4930845 B2 2/2012
KR 10-0349586 B1 8/2002

(Continued)

OTHER PUBLICATIONS

Patent Abstracts of Japan, Publication No. 2009-017446, dated Jan. 22, 2009, for corresponding Application No. JP 4930845 B2, listed above, 1 page.

(Continued)

*Primary Examiner* — Mihir K Rayan
(74) *Attorney, Agent, or Firm* — Lewis Roca Rothgerber Christie LLP

(57) ABSTRACT

A liquid crystal display includes: a liquid crystal panel comprising a plurality of pixel areas, each having a plurality of pixels; and a signal controller configured to receive an original image signal and to generate a target image signal corresponding to the original image signal by using a kickback voltage at each gray level in the original image signal, wherein the signal controller comprises a dithering unit configured to generate a corrected image signal based on dithering patterns corresponding to the target image signal.

15 Claims, 20 Drawing Sheets

(56) References Cited

U.S. PATENT DOCUMENTS

| | | | | |
|---|---|---|---|---|
| 2005/0162369 | A1* | 7/2005 | Kim | G09G 3/3611 345/98 |
| 2006/0119559 | A1* | 6/2006 | Jung | G09G 3/3614 345/96 |
| 2007/0120794 | A1* | 5/2007 | Shin | G09G 3/3648 345/89 |
| 2008/0198122 | A1* | 8/2008 | Shin | G09G 3/3648 345/94 |
| 2008/0224983 | A1* | 9/2008 | Lee | G09G 3/3648 345/98 |
| 2009/0085898 | A1* | 4/2009 | Wang | G09G 3/2044 345/204 |
| 2009/0267962 | A1 | 10/2009 | Kim et al. | |
| 2009/0289883 | A1* | 11/2009 | Choi | G09G 3/2044 345/89 |
| 2010/0053185 | A1* | 3/2010 | Hwang | G09G 3/2055 345/556 |
| 2010/0128028 | A1* | 5/2010 | Lee | G09G 3/3677 345/214 |
| 2013/0064445 | A1 | 3/2013 | Eddy et al. | |

FOREIGN PATENT DOCUMENTS

| | | | |
|---|---|---|---|
| KR | 10-2005-0060228 | A | 6/2005 |
| KR | 10-0570968 | B1 | 4/2006 |
| KR | 10-2006-0088671 | A | 8/2006 |
| KR | 10-0685815 | B1 | 2/2007 |
| KR | 10-1244485 | B1 | 3/2013 |

OTHER PUBLICATIONS

Korean Patent Abstracts, Publication No. 1020010077525, dated Aug. 20, 2001, for corresponding Korean Patent No. KR 10-0349586 B1, listed above, 1 page.

Korean Patent Abstracts, Publication No. 1020060092668 A, dated Aug. 23, 2006, for corresponding Korean Patent No. KR 10-0685815 B1, listed above, 1 page.

Korean Patent Abstracts, Publication No. 1020070120279 A, dated Dec. 24, 2007, for corresponding Korean Patent No. KR 10-1244485 B1, listed above, 1 page.

* cited by examiner

LIQUID CRYSTAL DISPLAY

CROSS-REFERENCE TO RELATED APPLICATION

This application claims priority to and the benefit of Korean Patent Application No. 10-2014-0013096, filed on Feb. 5, 2014, in the Korean Intellectual Property Office, the entire disclosure of which is hereby incorporated by reference.

BACKGROUND

1. Field

Aspects of example embodiments of the present invention relate to a liquid crystal display.

2. Description of the Related Art

A liquid crystal display (LCD) includes a first display substrate having a pixel electrode, a second display substrate having a common electrode, liquid crystals having dielectric anisotropy and injected between the first display substrate and the second display substrate, a gate driver driving a plurality of gate lines, a data driver outputting data signals, and a timing controller controlling the above elements.

LCDs display an image by appropriately processing an image signal received from an external source using the timing controller, the gate driver, and the data driver and providing the processed image signal to a liquid crystal display panel. Here, the timing controller may dither the original image signal in order to express various gray levels.

LCD panels use a thin-film transistor (TFT) as a switching device, and parasitic capacitance created between a gate electrode and a drain electrode of the TFT may generate a kickback voltage, which may distort a voltage applied to the pixel electrode. For example, the kickback voltage may distort the voltage applied to the pixel electrode in a way that lowers the voltage of the pixel electrode regardless of polarity, and the magnitude of the kickback voltage, that is, the degree of voltage distortion may be different at different gray levels.

Therefore, the kickback voltage may cause a positive effective voltage and a negative effective voltage of the pixel electrode to become asymmetrical to each other, which may further cause an afterimage, a flicker, crosstalk, etc. on an image displayed on the LCD panel, thereby degrading the display quality of the LCD panel.

SUMMARY

Aspects of embodiments of the present invention include a liquid crystal display (LCD) having relatively improved display quality.

Aspects of embodiments of the present invention include an LCD, which may compensate for a kickback voltage.

However, embodiments of the present invention are not restricted to those set forth herein. The above and other aspects of the present invention will become more apparent to one of ordinary skill in the art to which the present invention pertains by referencing the detailed description of example embodiments of the present invention given below.

According to embodiments of the present invention, a liquid crystal display (LCD) includes: a liquid crystal panel including a plurality of pixel areas, each of the pixel areas having a plurality of pixels; and a signal controller configured to receive an original image signal and to generate a target image signal corresponding to the original image signal by using a kickback voltage at each gray level in the original image signal, wherein the signal controller comprises a dithering unit configured to generate a corrected image signal based on dithering patterns corresponding to the target image signal.

The signal controller may include: a storage unit configured to store the kickback voltage at each gray level and the dithering patterns; a gray determination unit configured to determine a gray level of the target image signal by analyzing a gray level of the original image signal; and the dithering unit configured to generate a corrected image signal by correcting a target image signal corresponding to each pixel area.

The storage unit may include: a first storage unit configured to store the kickback voltage at each gray level; and a second storage unit configured to store a target image signal, an expanded target image signal, a plurality of eigenvalues, and dithering patterns corresponding to the eigenvalues, wherein the kickback voltage at each gray level comprises a positive kickback voltage at each gray level and a negative kickback voltage at each gray level.

The gray determination unit may include: a selector configured to select a gray level of each pixel area; and a compensator configured to generate the target image signal by compensating the original image signal corresponding to the selected gray level using the kickback voltage at each gray level received from the first storage unit.

The dithering unit may include: an expander configured to expand data of the target image signal to generate an expanded target image signal; a dithering pattern selector configured to select a dithering pattern corresponding to each pixel area; and a dithering processor configured to apply the selected dithering pattern to each pixel area.

The expander may be further configured to output an expanded target image signal by expanding the data of the target image signal by k bits.

The second storage unit may include a lookup table (LUT) mapped to data of the expanded target image signal which corresponds to the target image signal.

The dithering pattern selector may include: a designated value generator configured to generate a designated value corresponding to the target image signal for each polarity provided by the gray determination unit; and a dithering pattern determiner configured to select a plurality of eigenvalues corresponding to the designated value for each polarity and to apply a dithering pattern corresponding to each of the selected eigenvalues to the pixel area.

The designated value generator may include: a frame counter configured to count each frame; a first counter configured to count a movement of a target pixel area in a first direction; and a second counter configured to count the movement of the target pixel area in a second direction, wherein the designated value generator is configured to generate the designated value using the frame counter, the first counter, and the second counter.

The first direction may be a row direction of the pixel areas, and the second direction is a column direction of the pixel areas.

When a second frame begins after a first frame ends, a dithering pattern corresponding to a reference pixel area of the second frame may be different from a dithering pattern corresponding to a reference pixel area of the first frame.

The dithering processor may include: a reducing unit configured to generate a corrected image signal by reducing the data of the expanded target image signal by k bits; and a driving unit configured to transmit the corrected image signal to a data driver.

The corrected image signal may include a positive corrected image signal and a negative corrected image signal, wherein the driving unit may be configured to alternately transmit the positive corrected image signal and the negative corrected image signal to the liquid crystal panel in each frame.

The driving unit may be configured to alternately transmit data corresponding to the positive corrected image signal and data corresponding to the negative corrected image signal in every two frames.

According to embodiments of the present invention, an LCD includes: a liquid crystal panel including a plurality of pixel areas, each of the pixel areas having a plurality of pixels; and a signal controller configured to receive an original image signal and to generate a target image signal corresponding to the original image signal by using a kickback voltage at each gray level in the original image signal, wherein the signal controller is configured to transmit a corrected image signal, whose polarity is inverted every frame, to the liquid crystal panel.

The signal controller may include: a storage unit configured to store the kickback voltage at each gray level and dithering patterns; a gray determination unit configured to determine a gray level of the target image signal by analyzing a gray level of the original image signal; and a dithering unit configured to generate a corrected image signal by correcting a target image signal corresponding to each pixel area.

The dithering unit may include: a designated value generator configured to generate a designated value corresponding to the target image signal for each polarity provided by the gray determination unit; and a dithering pattern determiner configured to select a plurality of eigenvalues corresponding to the designated value for each polarity and to apply a dithering pattern corresponding to each of the selected eigenvalues to the pixel area.

If the designated value for each polarity is equal, when a second frame begins after a first frame ends, a dithering pattern corresponding to a reference pixel area of the second frame may be different from a dithering pattern corresponding to a reference pixel area of the first frame.

According to embodiments of the present invention, an LCD includes: a liquid crystal panel comprising a plurality of pixel areas, each of the pixel areas having a plurality of pixels; and a signal controller configured to receive an original image signal and to generate a target image signal corresponding to the original image signal by using a kickback voltage at each gray level in the original image signal, wherein the signal controller is configured to transmit a corrected image signal to the liquid crystal panel, wherein a polarity of the corrected image signal is inverted every two successive frames.

The signal controller may include: a storage unit configured to store the kickback voltage at each gray level and dithering patterns; a gray determination unit configured to determine a gray level of the target image signal by analyzing a gray level of the original image signal; and a dithering unit configured to generate a corrected image signal by correcting a target image signal corresponding to each pixel area, wherein the dithering unit may include: a designated value generator configured to generate a designated value corresponding to the target image signal for each polarity provided by the gray determination unit; and a dithering pattern determiner configured to select a plurality of eigenvalues corresponding to the designated value for each polarity and to apply a dithering pattern corresponding to each of the selected eigenvalues to the pixel area.

BRIEF DESCRIPTION OF THE DRAWINGS

The above and other aspects and features of embodiments of the present invention will become more apparent by describing in some detail example embodiments thereof with reference to the attached drawings, in which.

DETAILED DESCRIPTION

Figure 1:
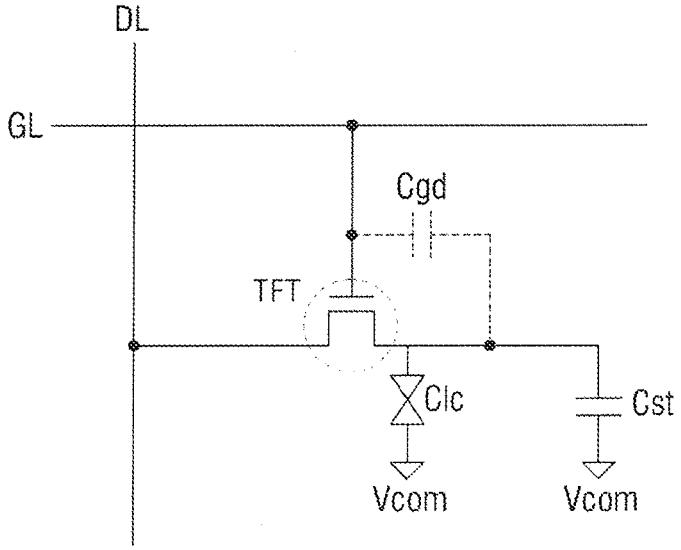
FIG. 1 is an equivalent circuit diagram of a pixel included in a liquid crystal display panel.

Embodiments of the present invention will now be described more fully with reference to the accompanying drawings, in which example embodiments of the invention are shown. The invention may, however, be embodied in many different forms and should not be construed as being limited to the embodiments set forth herein. Rather, these embodiments are provided so that this disclosure will be thorough and complete, and will more fully convey the concept of the invention to those skilled in the art.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer, and/or section from another element, component, region, layer, and/or section. Thus, a first element, component, region, layer, and/or section discussed below could be termed a second element, component, region, layer, and/or section without departing from the teachings of the present invention.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "below," "beneath," "lower," "above," and "upper" may be used herein to describe one element's relationship to another element as shown in the accompanying drawings. It will be understood that relative terms are intended to encompass different orientations of the device in addition to the orientation depicted in the accompanying drawings. For example, if the device in the accompanying drawings is turned over, elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "beneath" can, therefore, encompass both an orientation of above and below.

Hereinafter, embodiments of the present invention will be described with reference to the attached drawings.

Figure 2:
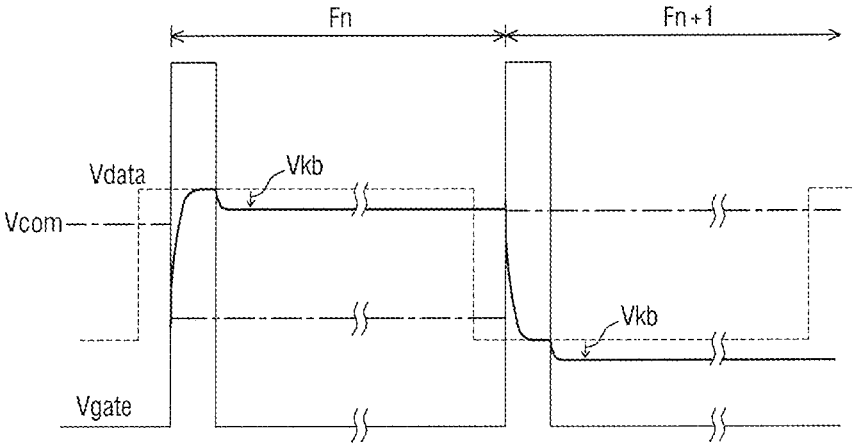
FIG. 2 illustrates a waveform when the pixel of FIG. 1 is driven.

FIG. 1 is an equivalent circuit diagram of a pixel included in a liquid crystal display panel. FIG. 2 illustrates a waveform when the pixel of FIG. 1 is driven.

Referring to FIGS. 1 and 2, the liquid crystal display panel includes a gate line GL, a data line DL which crosses the gate line GL, and a thin-film transistor ("TFT"), which is formed at an intersection of the gate line GL and the data line DL to drive a liquid crystal cell Clc. The liquid crystal display panel further includes a storage capacitor Cst for maintaining a voltage of the liquid crystal cell Clc. The liquid crystal cell Clc blocks light or adjusts the amount of light that is transmitted therethrough as the arrangement of liquid crystal molecules is changed by an electric field applied to a liquid crystal layer when a data voltage is applied to a pixel electrode and a common voltage Vcom is applied to a common electrode. The data voltage is provided as a gamma voltage preset according to driving voltage characteristics of the liquid crystal cell Clc.

FIG. 2 illustrates a waveform when the pixel of FIG. 1 is driven. For example, FIG. 2 illustrates a gate signal transmitted to the gate line GL and a voltage Vlc charged in the liquid crystal cell Clc.

Referring to FIG. 2, a gate signal swings between a gate high voltage set to a voltage for turning on the TFT and a gate low voltage set to a voltage for turning off the TFT.

In a scanning period during which the gate signal is maintained as the gate high voltage, the liquid crystal cell Clc is charged with a data signal Vdata provided as a gamma voltage and maintains the charged voltage for a certain period of time using a voltage charged in the storage capacitor Cst.

If voltages of the same polarity are continuously applied to the liquid crystal cell Clc, liquid crystals and a displayed image may be degraded. Therefore, a liquid crystal display (LCD) may drive the liquid crystal cell Clc using an alternating current (AC) data signal-Vdata whose polarity is inverted periodically.

Such inversion driving may be achieved by frame inversion, line inversion, dot inversion, etc. In the case of frame inversion, for example, the polarity of the data signal Vdata is inverted every frame, as illustrated in the drawing.

Here, the common voltage Vcom may be provided as a direct current (DC) voltage at the same level, but the polarity of the common voltage Vcom may be inverted to be opposite to the polarity of the data signal Vdata, as illustrated in the drawing.

In this case, however, a kickback voltage Vkb generated by the parasitic capacitance of the TFT serves as a major factor that may degrade the image quality of the LCD.

Here, Cgd indicates parasitic capacitance formed between a gate electrode and a drain electrode of the TFT coupled to the gate line GL as illustrated in FIG. 1. In addition, Clc indicates liquid crystal capacitance, and Cst indicates storage capacitance.

The kickback voltage Vkb changes the data voltage Vdata applied to the pixel electrode of the liquid crystal cell Clc, thereby creating a flicker and an afterimage on a displayed image. For example, if the polarity of the data signal Vdata is inverted at 60 Hz, a luminance difference occurs between an odd-numbered frame and an even-numbered frame due to the kickback voltage Vkb. Accordingly, a flicker of 30 Hz appears on the displayed image. If the LCD operates for a long time in this state, a DC offset is applied to the liquid crystal cell Clc, thus shifting voltage-to-transmittance characteristics of the liquid crystal cell Clc and causing image sticking.

Figure 3:
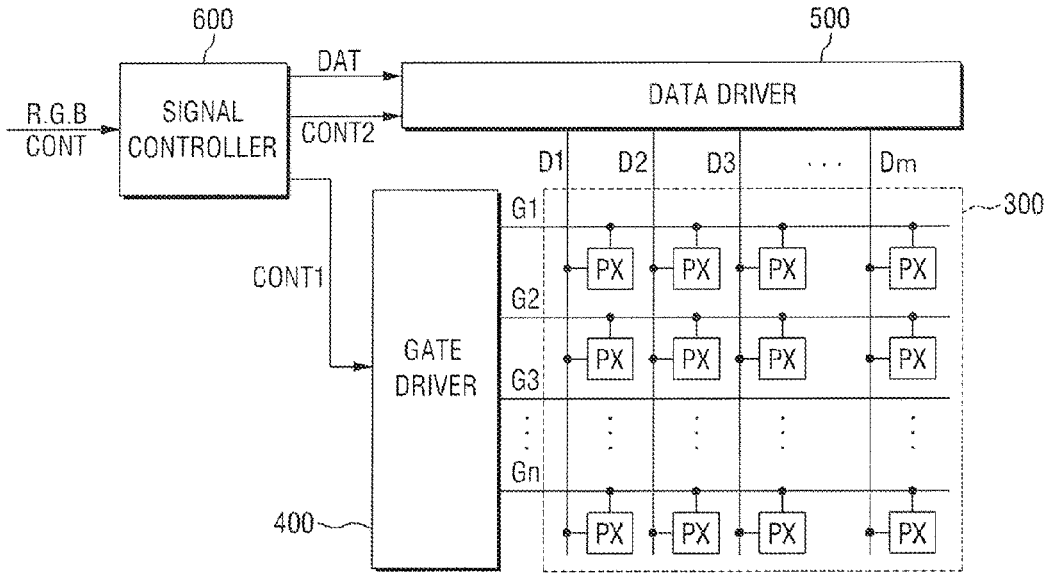
FIG. 3 is a block diagram of a liquid crystal display (LCD) according to an embodiment of the present invention.
Figure 4:
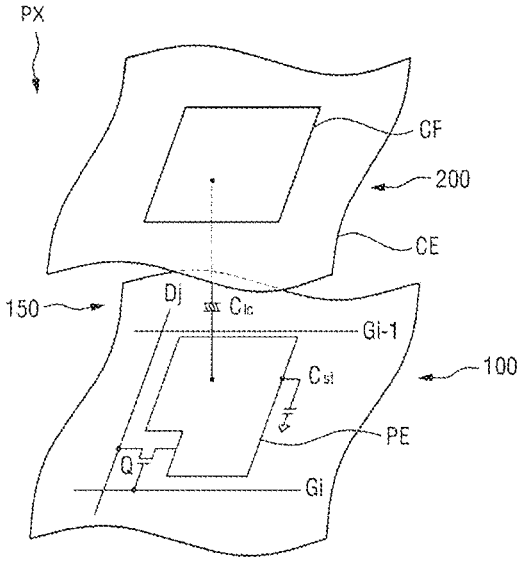
FIG. 4 is an equivalent circuit diagram of one pixel included in the LCD of FIG. 3.

FIG. 3 is a block diagram of an LCD according to an embodiment of the present invention. FIG. 4 is an equivalent circuit diagram of one pixel included in the LCD of FIG. 3.

Referring to FIGS. 3 and 4, the LCD according to the current embodiment includes a liquid crystal panel 300, a gate driver 400 coupled to the liquid crystal panel 300, a data driver 500, and a signal controller 600 controlling the above elements.

When viewed in an equivalent circuit, the liquid crystal panel 300 includes a plurality of display signal lines (G1 through Gn, D1 through Dm) and a plurality of pixels PX, which are coupled to the display signal lines (G1 through Gn, D1 through Dm) and are arranged in a matrix. The pixels PX are included in a plurality of pixel areas PA. In other words, the liquid crystal panel 300 is divided into a plurality of pixel areas PA, and a plurality of pixels PX are included in each of the pixel areas PA. In addition, a dithering pattern dith corresponding to each of the pixel areas PA (described in more detail below) is provided and used to correct an original image signal OS for displaying an image on each of the pixel area PA. This will be described in detail later.

The display signal lines (G1 through Gn, D1 through Dm) include a plurality of gate lines G1 through Gn, which deliver gate signals and a plurality of data lines D1 through Dm, which deliver data signals. The gate lines G1 through Gn extend along a first direction and are parallel or substantially parallel to each other. The data lines D1 through Dm extend along a second direction and are parallel or substantially parallel to each other. The first direction may be a row direction, and the second direction may be a column direction.

The gate driver 400 outputs a gate-on voltage Von or a gate-off voltage Voff sequentially to the gate lines G1 through Gn in response to a gate control signal CONT1 received from the signal controller 600.

The data driver 500 receives a data control signal CONT2 and image data DAT from the signal controller 600, selects gray voltages corresponding to the image data DAT, and provides the selected gray voltages to the data lines D1 through Dm.

The gate control signal CONT1 is used to control the operation of the gate driver 400 and includes a vertical start signal STV for starting the operation of the gate driver 400, a gate clock signal CPV for determining the output timing of the gate-on voltage Von, and an output enable signal OE for determining a pulse width of the gate-on voltage Von. The data control signal CONT2 is used to control the operation of the data driver 500 and includes a horizontal start signal STH for starting the operation of the data driver 500 and an output instruction signal for instructing the output of data voltages.

The signal controller 600 may receive, from an external graphic controller, red, green, and blue signals R, G, and B and external clock signals for controlling the display of the red, green, and blue signals R, G, and B. The external clock signals include a data enable signal DE, a vertical synchronization signal Vsyn, a horizontal synchronization signal Hsyn, and a main clock signal Mclk. The data enable signal DE remains high while the red, green and blue signals R, G and B are input, thereby indicating that signals provided by the external graphic controller (not shown) are the red, green and blue signals R, G and B. The vertical synchronization signal Vsync indicates the start of a frame, the horizontal synchronization signal Hsync distinguishes gate lines, and the main clock signal Mclk is a clock signal with which all signals required for the operation of the LCD are synchronized.

The signal controller 600 receives an original image signal R.G.B (i.e., the red, green and blue signals R, G and B) needed to display an image on the liquid crystal panel 300, generates image data DAT corresponding to the original image signal R.G.B, and provides the image data DAT to the data driver 500. The signal controller 600 generates internal clock signals (i.e., the gate control signal CONT1 and the data control signal CONT2) based on the input external clock signals Vsync, Hsync, Mclk, and DE.

Figure 7:
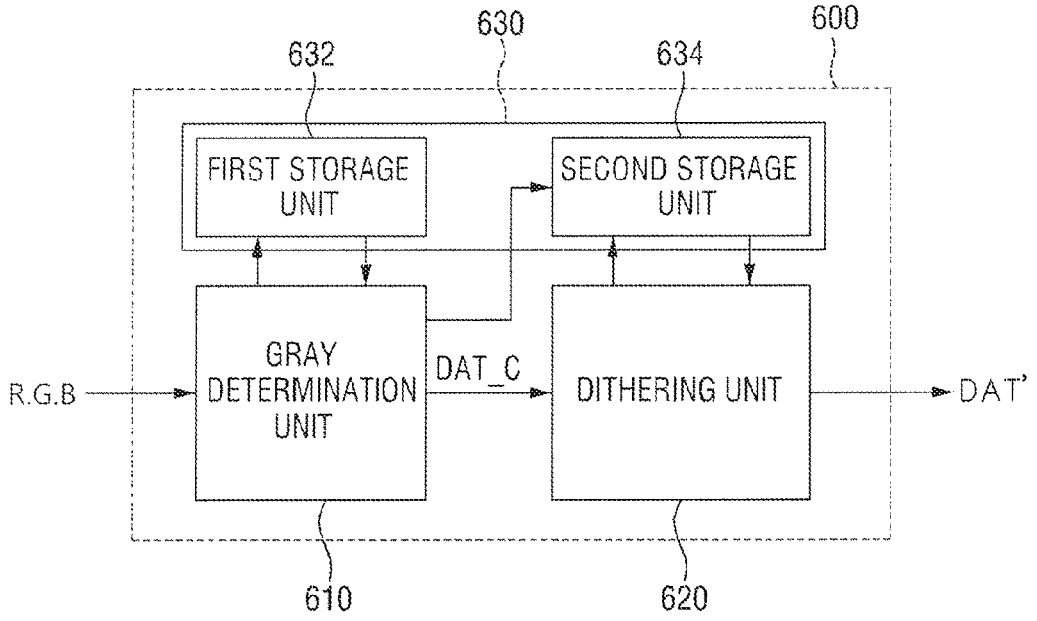
FIG. 7 is a block diagram of the signal controller included in the LCD of FIG. 3.

As shown, for example, in FIG. 7, the signal controller 600 may include a gray determination unit 610, a dithering unit 620, and a storage unit 630. The gray determination unit 610 analyzes a gray level of the original image signal DAT and transmits gray information of each pixel area PA together with the image signal DAT. The dithering unit 620 selects a dithering pattern dith corresponding to the gray information of each pixel area PA and corrects the image signal DAT based on the selected dithering pattern dith. The storage unit 630 stores dithering patterns dith.

Referring to FIG. 4, one pixel PX of the liquid crystal panel 300 includes a liquid crystal capacitor Clc and may include a storage capacitor Cst. The liquid crystal capacitor Clc may include a pixel electrode PE formed on a first display substrate 100, a common electrode CE formed on a second display substrate 200, and a liquid crystal layer 150 interposed between the pixel electrode PE and the common electrode CE. A color filter CF may be formed on a region of the second display substrate 200. A switching device Q may be coupled to an $i^{th}$ gate line Gi (i=1 to n) and a $j^{th}$ data line Dj (j=1 to m) so as to provide a data voltage to the liquid crystal capacitor Clc.

A common voltage Vcom is applied to the common electrode CE, and a data voltage Vdata provided by the data driver 500 is applied to the pixel electrode PE via one of the data lines D1 through Dm. The liquid crystal capacitor Clc is charged with a difference between the common voltage Vcom and the data voltage Vdata to display an image.

Figure 5:
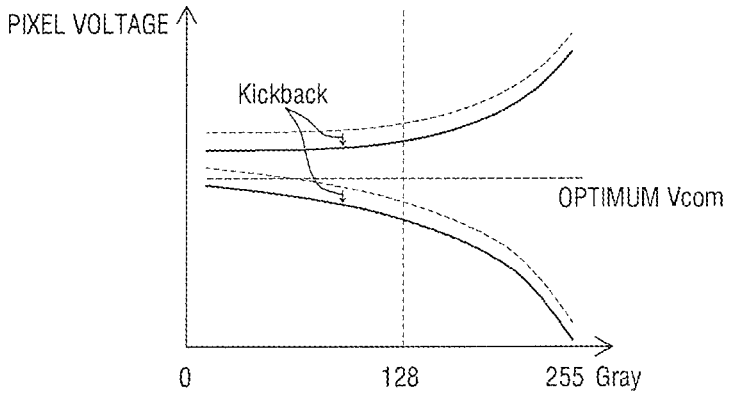
FIG. 5 is a graph illustrating the relationship between a voltage actually charged in a pixel and an optimum common voltage.

FIG. 5 is a graph illustrating the relationship between a voltage actually charged in a pixel and an optimum common voltage Vcom.

Referring to FIG. 5, the dotted graphs (e.g., the dotted lines or curves) represent the relationship between a pixel voltage applied to each pixel and a gray level expected for the applied voltage. In addition, solid graphs represent a voltage applied to each pixel at each gray level under the effect of a kickback voltage Vkb. Even if a positive data voltage and a negative data voltage expressing the same gray level are applied to each pixel, an absolute value of the positive pixel voltage and an absolute value of the negative pixel voltage are different due to the kickback voltage Vkb. For example, the absolute value of the negative pixel voltage may be greater than that of the positive pixel voltage. In this case, the absolute values of the pixel voltages of the two polarities may be made to be equal at a certain gray level by adjusting a level of the common voltage Vcom, for example, by lowering the common voltage Vcom such that the positive pixel voltage and the negative pixel voltage are symmetrical to each other with respect to the common voltage Vcom.

However, because the kickback voltage Vkb has a different effect at each gray level, even if the pixel voltages are made to be symmetrical to each other with respect to the common voltage Vcom at any one gray level, the pixel voltages may not be symmetrical with respect to the common voltage Vcom at other gray levels. Therefore, according to embodiments of the present invention, the level of the common voltage Vcom is not adjusted. Instead, the pixel voltages of the two polarities are made by the signal controller 600 to be symmetrical to each other with respect to the common voltage Vcom over the entire gray scale (e.g., an entire range of gray levels from 0 to 255) as represented by the solid graphs of FIG. 5.

Figure 6:
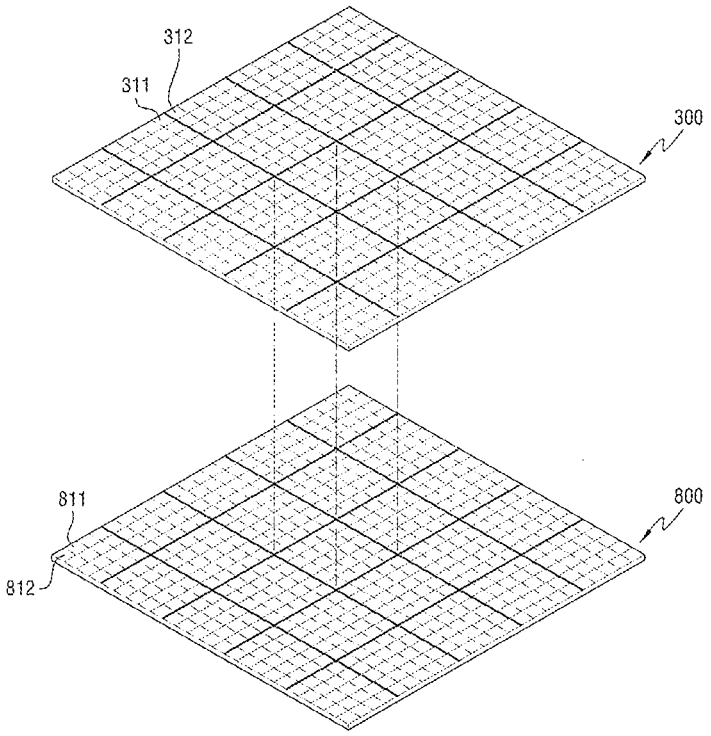
FIG. 6 is a conceptual diagram illustrating the corresponding relationship between the liquid crystal panel and the dithering pattern array in the LCD of FIG. 3.

FIG. 6 is a conceptual diagram illustrating the corresponding relationship between the liquid crystal panel 300 and a dithering pattern array 800 in the LCD of FIG. 3.

Referring to FIG. 6, the corresponding relationship between the liquid crystal panel 300 and the dithering pattern array 800 is as follows.

A plurality of pixel areas 310 and 320 may be arranged in a matrix of a rows×b columns, where a and b are natural numbers. Each of the pixel areas 310 and 320 may be a unit to which a dithering pattern 810 or 820 is applied. Further, if each dithering pattern 810 includes a plurality of dithering pixels 811 arranged in a 4×4 matrix, each pixel area 310 may also include a plurality of pixels 311 arranged in a 4×4 matrix. In addition, the pixels 311 of each pixel area 310 may respectively correspond to the dithering pixels 811 of each dithering pattern 810.

Of the pixel areas 310 and 320, a first pixel area 310 contacts at least a surface of each of a plurality of second pixel areas 320. The first pixel area 310 and the second pixel areas 320 may correspond to different dithering patterns 810 and 820. For example, the liquid crystal panel 300 may include the first pixel area 310 and four second pixel areas 320 which contact upper, lower, left and right surfaces of the first pixel area 310. Here, a first dithering pattern 810 corresponding to the first pixel area 310 and four second dithering patterns 820 corresponding to the second pixel areas 320 are different. When a pixel area 310 or 320 contacts a surface of another pixel area 310 or 320, it means that pixels 311 or 312 located at an outermost part of the former pixel area 310 or 320 are adjacent to pixels 311 or 312 located at an uppermost, lowermost, rightmost, or leftmost part of the latter pixel area 310 or 320.

Further, at least two of the four second dithering patterns 820 may be different. That is, in the case of the first dithering pattern 810 corresponding to the first pixel area 310 and the four second dithering patterns 820 corresponding to the second pixel areas 320, a second dithering pattern 820 located on an upper surface of the first dithering pattern 810 may be the same as any one of second dithering patterns 820 located on left and right surfaces of the first dithering pattern 810, and a second dithering pattern 820 located on a lower surface of the first dithering pattern 810 may be the same as the other one of the second dithering patterns 820 located on the left and right surfaces of the first dithering pattern 810.

FIG. 7 is a block diagram of the signal controller 600 included in the LCD of FIG. 3.

Referring to FIG. 7, the signal controller 600 may include the gray determination unit 610, the dithering unit 620, and the storage unit 630. As described above, the liquid crystal panel 300 is divided into a plurality of pixel areas 310 and 320, each including a plurality of pixels 311 or 312. The timing controller 600 corrects an original image signal R.G.B using a dithering pattern 810 or 820 that corresponds to each pixel area 310 or 320 for displaying an image on the liquid crystal panel 300.

The gray determination unit 610 may analyze a gray level of the input original image signal R.G.B and provide gray level information of the image signal R.G.B to the dithering unit 620 and the storage unit 630, together with the image signal R.G.B. The dithering unit 620 may correct the image signal R.G.B using dithering patterns dith corresponding to the gray level information received from the gray determination unit 610. In addition, the storage unit 630 may store a kickback voltage at each gray level when each of a positive voltage and a negative voltage is applied, a plurality of eigenvalues EV, and dithering patterns dith corresponding to the eigenvalues EV. Thus, a dithering pattern dith can be retrieved from the storage unit 630 using a designated value DV generated by the dithering unit 620.

The storage unit 630 may include a first storage unit 632 and a second storage unit 634. The first storage unit 632 exchanges data with the gray determination unit 610. The second storage unit 634 receives data from the gray determination unit 610 and exchanges data with the dithering unit 620. The first storage unit 632 may store a kickback voltage Vkb at each gray level when each of a positive voltage and a negative voltage is applied as well as target image data DAT_C that reflects the kickback voltage Vkb. Corrected image data DAT' may be generated using the target image data DAT_C and a color correction lookup table (LUT). The color correction LUT is an accurate color control (ACC) related LUT that accurately expresses red, green and blue colors according to characteristics of a liquid crystal panel. The second storage unit 634 may store a plurality of dithering patterns dith and the target image data DAT_C provided by the gray determination unit 610. The dithering patterns dith may be stored as an LUT. For example, if the dithering patterns dith are stored as an LUT in the form of an 8×8 matrix, rows of the LUT may store compensation values (e.g., 1/8, 2/8, 3/8, 4/8, 5/8, 6/8, 7/8, and 8/8) that are to be applied to a gray value of each pixel area by using dithering, and columns of the LUT may store a plurality of, that is, eight dithering patterns designed to apply each correction value. In other words, a plurality of dithering patterns may be provided for each correction value that is to be applied to each display area, n bits may be designated for each correction value, and m dithering patterns may be applied to each correction value. In this case, $2^n \times m$ dithering patterns may be stored in the storage unit 630. Here, each dithering pattern dith may include an eigenvalue EV, which will be described in detail later. The storage unit 630 may also store the dithering patterns dith in various ways other than the above method.

Figure 8:
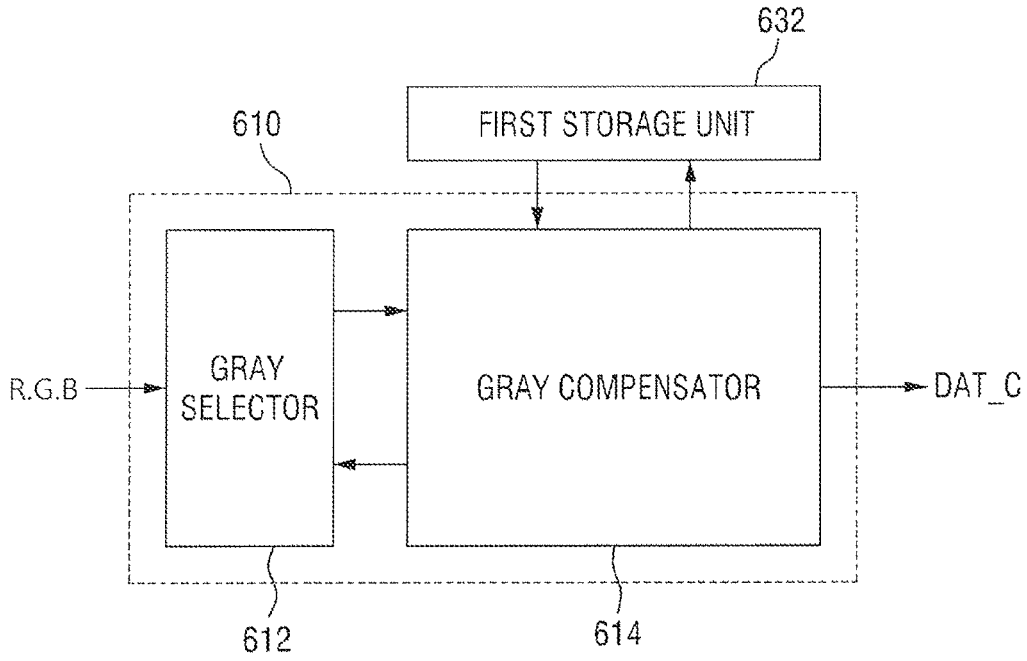
FIG. 8 is a block diagram of the gray determination unit of FIG. 7.
Figure 9:
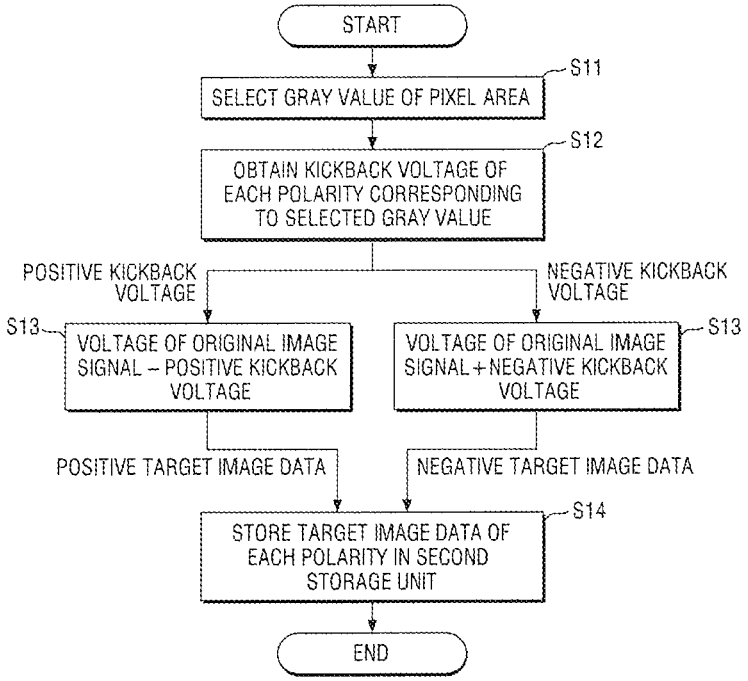
FIG. 9 is a flowchart illustrating the operation of the gray determination unit included in the LCD of FIG. 3.

FIG. 8 is a block diagram of the gray determination unit 610 of FIG. 7. FIG. 9 is a flowchart illustrating the operation of the gray determination unit 610 included in the LCD of FIG. 3.

Referring to FIGS. 8 and 9, the gray determination unit 610 may include a gray selector 612 and a gray compensator 614.

The gray selector 612 may receive an original image signal R.G.B and select a gray value (or gray level) that should be applied to each pixel. The original image signal DAT may be provided as an 8-bit signal, and a gray value of each pixel may be selected from 256 gray values (e.g., a gray level ranging from 0 to 255). In the case of a signal having more than 8 bits, the gray value of each pixel may be selected from more than 256 gray values.

The gray compensator 614 may generate corrected data by combining data of the kickback voltage Vkb at each gray level stored in the first storage unit 632 and gray data selected by the gray selector 612. For example, the gray compensator 614 may receive gray information selected by the gray selector 612, obtain a positive kickback voltage and a negative kickback voltage corresponding to the selected gray information from the kickback voltage Vkb at each gray level stored in the first storage unit 632, and generate data corresponding to each of a positive target image signal DAT_Cp and a negative target image signal DAT_Cn by performing an arithmetic operation on a voltage of the original image signal DAT and each of the positive kickback voltage and the negative kickback voltage. The data corresponding to each of the positive target image signal DAT_Cp and the negative target image signal DAT_Cn may be provided to the dithering unit 620 and stored in the second storage unit 634.

Accordingly, referring to FIG. 9, in block S11, the gray determination unit 610 selects a gray value of a pixel area. In block S12, the gray determination unit 610 obtains a kickback voltage of each polarity corresponding to the selected gray value. In block S13, the gray determination unit 610 subtracts the positive kickback voltage from the voltage of the original image signal, and also adds the negative kickback voltage to the voltage of the original image signal to generate positive target image data and negative target image data, respectively. In block S14, the gray determination unit 610 stores the target image data of each polarity in a second storage unit.

Figure 10:
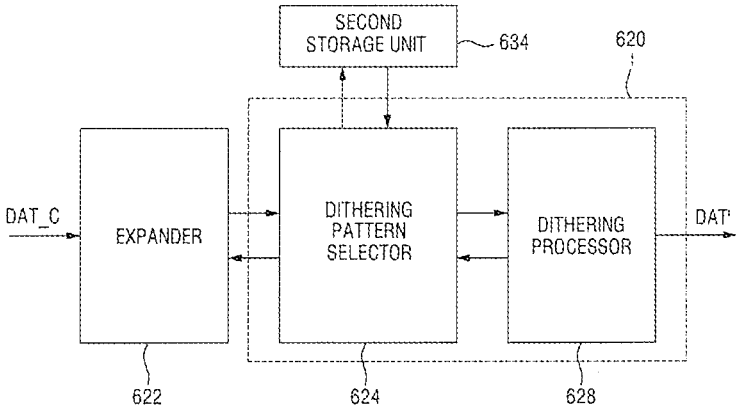
FIG. 10 is a block diagram of the dithering unit of FIG. 7.
Figure 11:
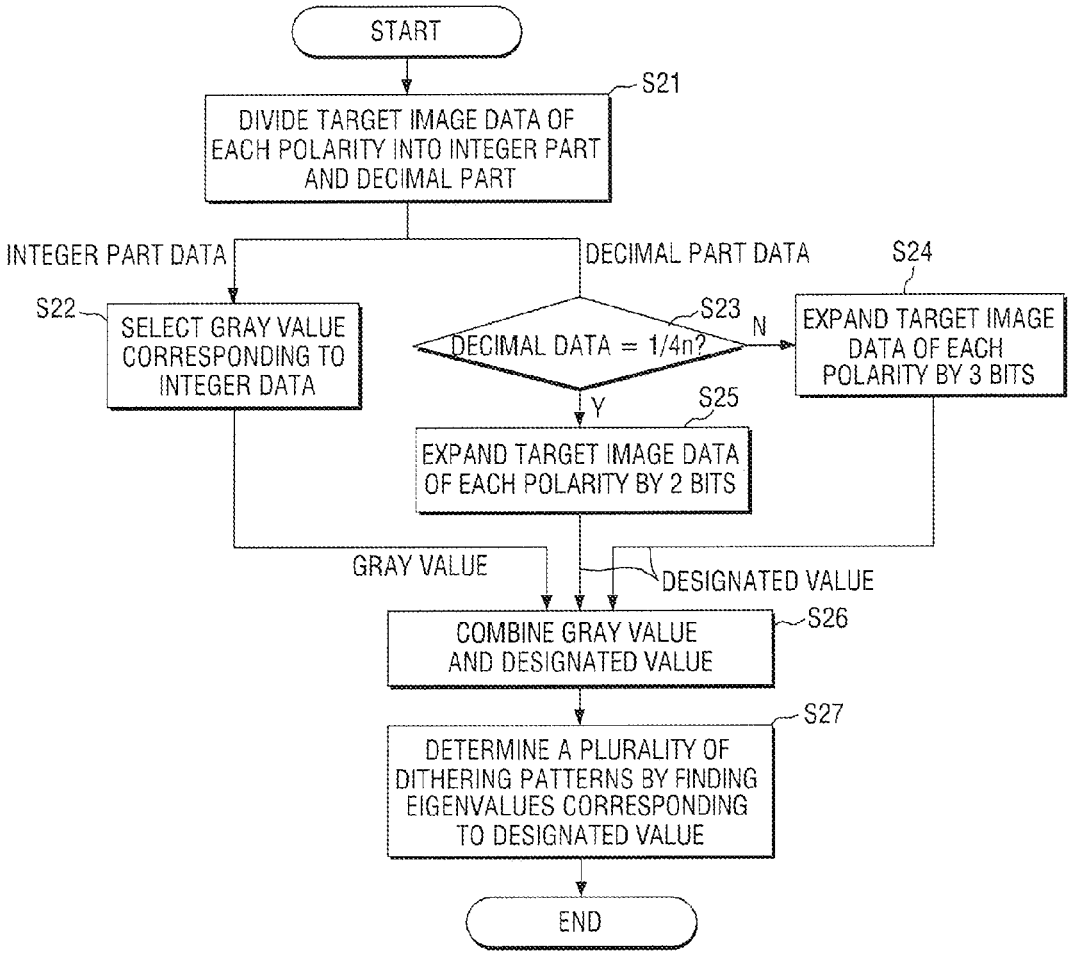
FIG. 11 is a flowchart illustrating the operation of the dithering unit included in the LCD of FIG. 3.
Figure 12:
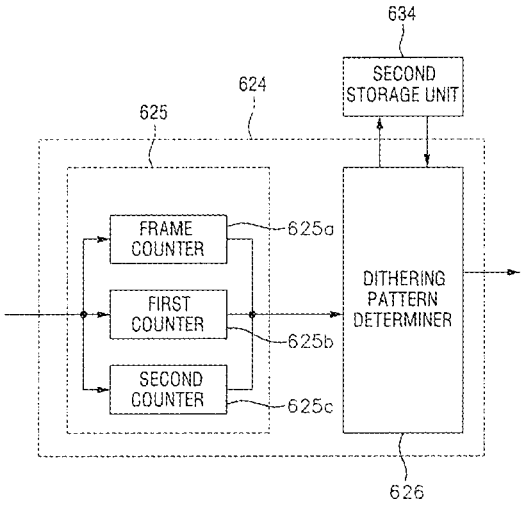
FIG. 12 is a block diagram of a dithering pattern selector of FIG. 10.

FIG. 10 is a block diagram of the dithering unit 620 of FIG. 7. FIG. 11 is a flowchart illustrating the operation of the dithering unit 620 included in the LCD of FIG. 3. FIG. 12 is a block diagram of a dithering pattern selector 624 of FIG. 10.

Referring to FIGS. 10 through 12, the dithering unit 620 may include an expander 622, the dithering pattern selector 624, and a dithering processor 628.

The dithering unit 620 receives a positive target image signal DAT_Cp and a negative target image signal DAT_Cn from the gray determination unit 610, expands each of the positive target image signal DAT_Cp and the negative target image signal DAT_Cn to (n+k) bits by using the expander 622, and outputs a positive expanded target image signal DAT_Cp' and a negative expanded target image signal DAT_Cn'. The dithering pattern selector 624 selects a plurality of dithering patterns dith corresponding to the positive expanded target image signal DAT_Cp' and the negative expanded target image signal DAT_Cn' and determines the order of the dithering patterns dith to be applied to the liquid crystal panel 300. The dithering processor 628 transmits the corrected image signal DAT' corresponding to the selected dithering patterns dith to the data driver 500. Accordingly, an image having improved image quality may be displayed.

The expander 622 may include an LUT, and the LUT may be mapped to color compensation data used to compensate for colors according to input data. The color compensation data is a result of expanding bits of the input data by k bits. For example, when 8-bit data of an $n^{th}$ frame is input, the expander 622 outputs (n+k)-bit expanded data of the $n^{th}$ frame by using the LUT. The (n+k)-bit expanded data of the $n^{th}$ frame may be divided into an integer part of upper n bits and a decimal part of lower k bits. The upper n bits may be data of a grayscale image, and the lower k bits may be a designated value DV which will be described later.

The dithering pattern selector 624 (shown, for example, in FIG. 12) may include a designated value generator 625, which includes a frame counter 625*a*, a first counter 625*b* and a second counter 625*c*, and a dithering pattern determiner 626 which determines a dithering pattern dith corresponding to an eigenvalue EV that corresponds to a generated designated value DV.

The designated value generator 625 may generate a designated value DV of each pixel area PA. The designated value DV of each pixel area PA may be generated by combining respective values of the frame counter 625*a*, the first counter 625*b*, and the second counter 625*c*. The dithering pattern determiner 626 may find an eigenvalue EV corresponding to each designated value DV, find a dithering pattern dith corresponding to each eigenvalue EV from among dithering patterns dith stored in the second storage unit 634, and determine the found dithering pattern dith to be a dithering pattern dith of each pixel area PA.

For example, the frame counter 625*a* counts each frame, the first counter 625*b* counts the movement of a target pixel area PA, whose dithering pattern dith is to be selected, in a first direction, and the second counter 625*c* counts the movement of the target pixel area PA in a second direction. Here, the first direction and the second direction may be a row direction and a column direction, respectively.

For example, each of the frame counter 625*a*, the first counter 625*b*, and the second counter 625*c* may be 3-bit counters. In this case, '000' may be recorded in all of the frame counter 625*a*, the first counter 625*b*, and the second counter 625*c* before the target pixel area PA is dithered. The value of '000' may be set as a designated value DV of a pixel area PA located at a first row and a first column of a first frame, and the pixel area PA in the first row and the first column of the first frame may be designated as a reference pixel area PAs.

After the reference pixel area PAs is dithered, the target pixel area PA is moved in the row direction, for example, to the right. Here, the first counter 625*b* counts the movement of the target pixel area PA in the first direction. Thus, '001' is recorded in the first counter 625*b*. When the target pixel area PA moves to the right a number of times, for example, eight times, '111' is recorded in the first counter 625*b*. Then, when the target pixel area PA moves again to the right, '000' is recorded in the first counter 625*b*. Accordingly, the same pattern as a dithering pattern dith corresponding to the pixel area PA in the first row and the first column is applied to the current pixel area PA.

After all pixel areas PA in the current row are dithered, the target pixel area PA moves to a first pixel area PA in a next row (that is, the first pixel area PA in the next row becomes the target pixel area PA). Here, the second counter 625*c* counts the movement of the target pixel area PA in the second direction, for example, in the column direction. Thus, '001' is recorded in the second counter 625*c*. Again, as the target pixel area PA moves to the right, the above process is repeated.

After all pixel areas PA of each column are dithered, the target pixel area PA moves to a next frame. Accordingly, '001' is recorded in the frame counter 625*a*. Thus, a dithering pattern dith different from the dithering pattern dith applied to the reference pixel area PAs of the previous frame may correspond to a pixel area PA in a first column and a first row of a new frame. For example, a dithering pattern dith corresponding to a pixel area PA on a right surface or a lower surface of the dithering pattern dith applied to the reference pixel area PAs of the previous frame may be applied to the pixel area PA in the first column and the first row of the new frame. Again, the pixel area PA in the first column and the first row of the new frame becomes the reference pixel area PAs of the new frame, and the same process as the process in the previous frame is repeated. Consequently, different dithering patterns dith correspond to the reference pixel areas PAs of the previous and new frames.

In summary, the designated value generator 625 generates a designated value DV of each pixel area PA by using the frame counter 625*a*, the first counter 625*b*, and the second counter 625*c*, and the dithering pattern determiner 626 determines a dithering pattern dith corresponding to the generated designated value DV. The determined dithering pattern dith is applied to each pixel area PA by the dithering processor 628.

The dithering processor 628 includes a reducing unit and a driving unit. The reducing unit generates an n-bit corrected image signal DAT' by reducing data of a target image signal expanded to (n+k) bits by k bits. The driving unit transmits the n-bit corrected image signal DAT' to the data driver 500.

The n-bit corrected image signal DAT' includes a positive corrected image signal DAT_p' and a negative corrected image signal DAT_n'. The driving unit may alternately provide the positive corrected image signal DAT_p' and the negative corrected image signal DAT_n' every frame.

Hereinafter, a method of driving the LCD of FIG. 3 will be described.

When an original image signal R.G.B for displaying an image on a plurality of pixel areas 310 and 320 is input, the gray determination unit 610 analyzes a gray level of the input original image signal R.G.B and transmits a target image signal DAT_C, which reflects a kickback voltage Vkb at each gray level, to the dithering unit 620.

The dithering unit 620 receives the target image signal DAT_C reflecting the kickback voltage Vkb at each gray level and generates a designated value DV corresponding to each pixel area 310 or 320. The designated value DV may be generated by combining the value of the frame counter 625*a* which counts each frame, the value of the first counter 625*b* which counts the movement of a target pixel area PA, whose dithering pattern is to be selected, in the first direction, and the value of the second counter 625*c* which counts the movement of the target pixel area PA in the second direction. Because the generation of the designated value DV has been described above in detail, some repeated description thereof will be omitted.

An eigenvalue EV corresponding to the designated value DV of each pixel area PA is obtained, a dithering pattern dith having the eigenvalue EV is found in the second storage unit 634, and the found dithering pattern dith is determined to be a dithering pattern dith corresponding to each pixel area PA. Then, the image signal R.G.B is corrected by applying the determined dithering pattern dith to each pixel area PA.

Referring to FIG. 11, in block S21, the dithering unit 620 divides the target image data of each polarity into an integer part and a decimal part. In block S22, the dithering unit 620 selects a gray value corresponding to the integer data. In block S23, the dithering unit 620 determines whether or not the decimal data is equal to 1/4n. If the decimal data is not equal to 1/4n, then in block S24, the dithering unit 620 expands the target image data of each polarity by three bits to generate a designated value. If the decimal data is equal to 1/4n, then, in block S25, the dithering unit 620 expands the target image data of each polarity by two bits to generate a designated value. In block S27, the dithering unit 620 combines the gray value corresponding to the integer data and the designated value. In block S27, the dithering unit 620 determines a plurality of dithering patterns by finding eigenvalues corresponding to the designated value.

Figure 13:
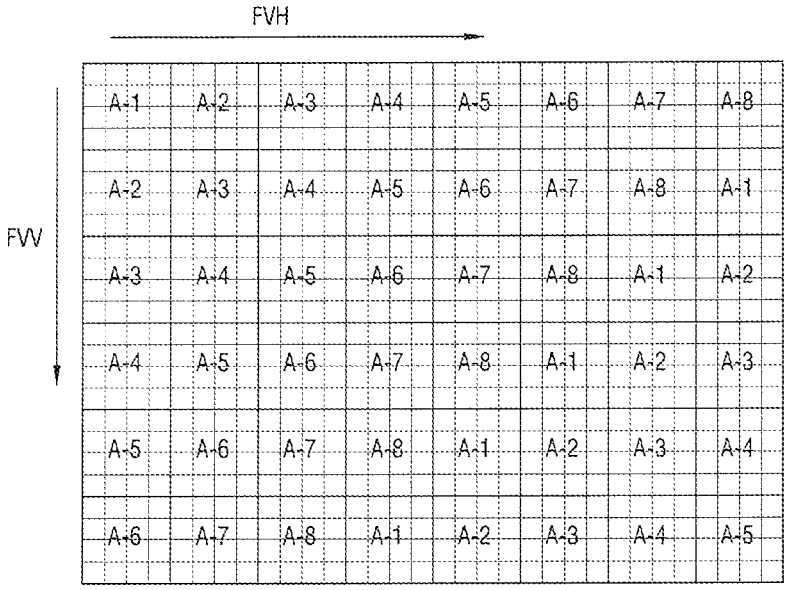
FIGS. 13 and 14 are diagrams illustrating dithering patterns applied to the liquid crystal panel of the LCD of FIG. 3.
Figure 14:
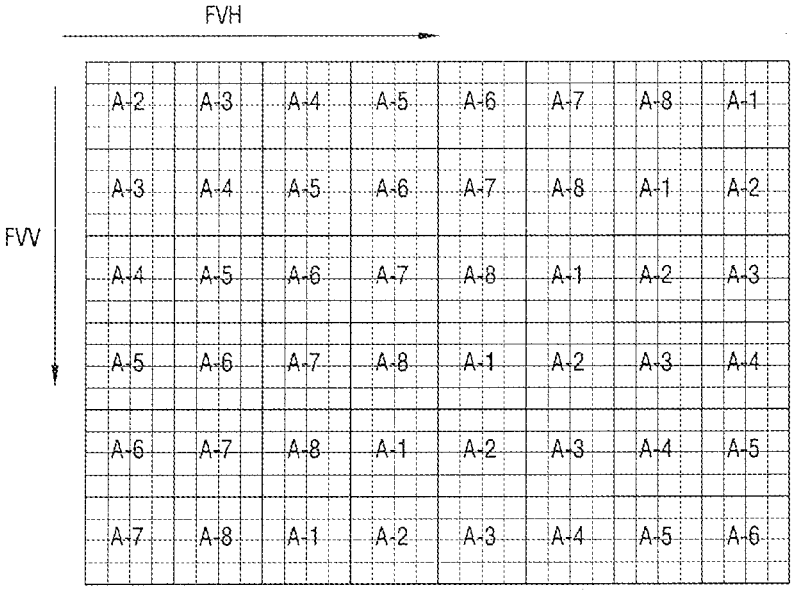

FIGS. 13 and 14 are diagrams illustrating dithering patterns applied to the liquid crystal panel of the LCD of FIG. 3.

Figure 15:
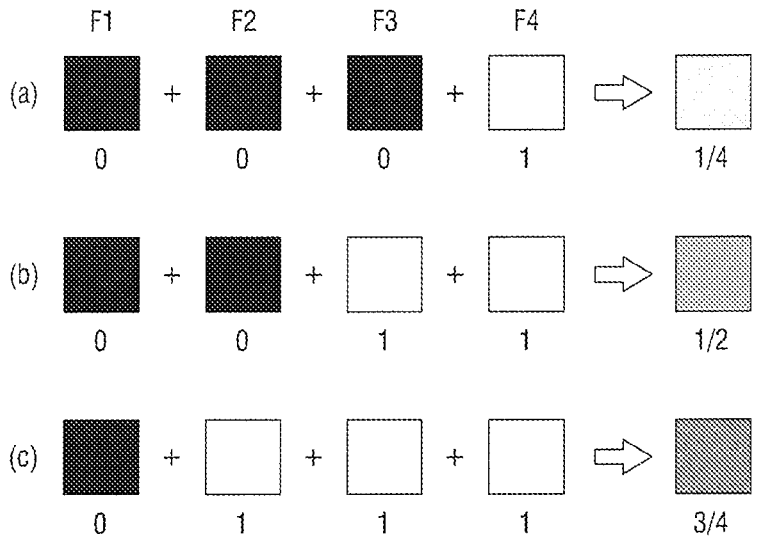
FIG. 15 is a diagram illustrating frame rate control (FRC)
Figure 16:
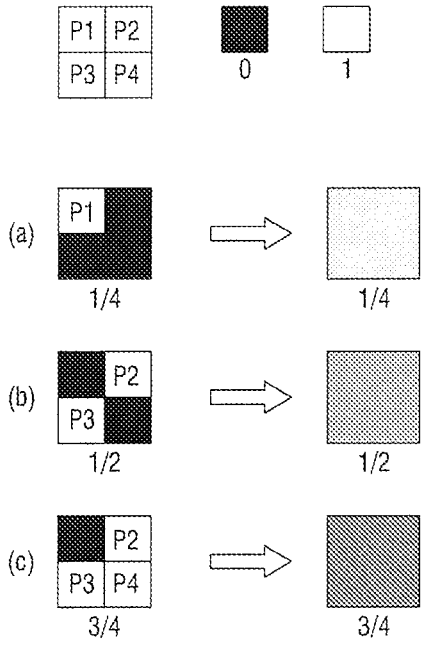
FIG. 16 is a diagram illustrating a dithering method.
Figure 17:
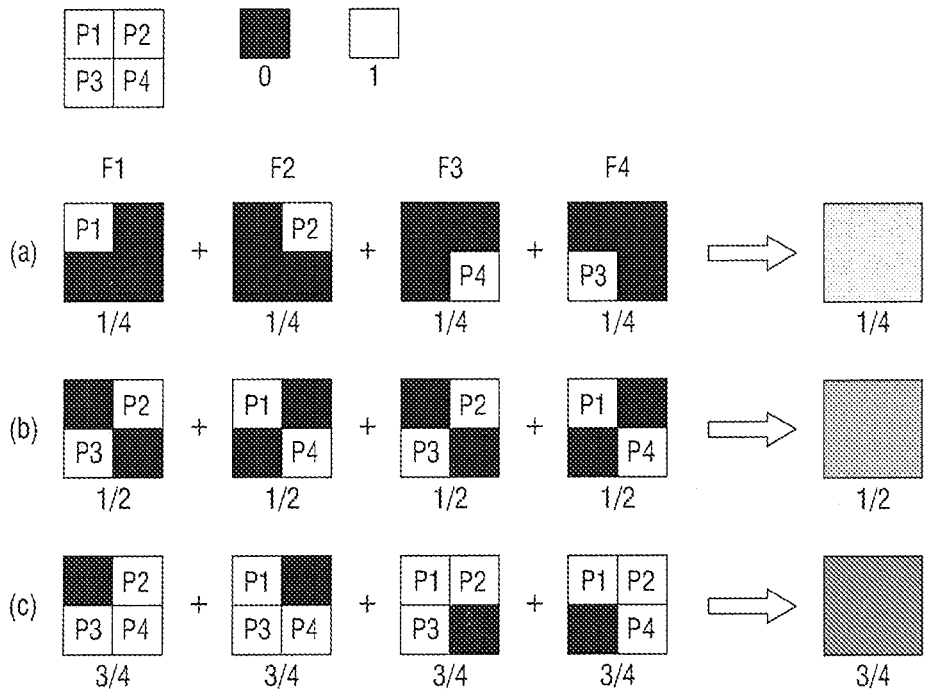
FIG. 17 is a diagram illustrating FRC using dithering patterns.

FIG. 15 is a diagram illustrating frame rate control (FRC). FIG. 16 is a diagram illustrating a dithering method. FIG. 17 is a diagram illustrating FRC using dithering patterns.

Referring to FIGS. 15 through 17, luminance can be finely adjusted by a gray value (or gray level) of a decimal less than one using a dithering method and an FRC method.

In the FRC method, a gray level perceived by the human eye may be changed according to the number of frames to which a compensation value is applied. For example, referring to (a) of FIG. 15, if a compensation value of '1' is added to image data during one of four frame periods, a gray value of each pixel becomes "gray value of image data+1/4." In addition, referring to (b) of FIG. 15, if the compensation value of '1' is added to image data during two of the four frame periods, the gray value of each pixel becomes "gray value of image data+1/2." Referring to (c) of FIG. 15, if the compensation value of '1' is added to image data during three of the four frame periods, the gray value of each pixel becomes "gray value of image data+3/4."

In the dithering method, to finely adjust luminance by a gray value of a decimal less than one, a compensation value is spatially dispersed by varying the number of pixels, to which the compensation value is added, in a dithering pattern that includes a plurality of pixels. For example, referring to (a) of FIG. 16, a dithering pattern may include a plurality of pixels arranged in a 2×2 matrix. In this case, if a compensation value of '1' is added to image data that is to be supplied to one of the pixels in the dithering pattern, a gray value of the dithering pattern is increased by a gray value of 1/4. Referring to (b) of FIG. 16, if the compensation value of '1' is added to image data that is to be supplied to two of the pixels in the dithering pattern, the gray value of the dithering pattern is increased by a gray value of 1/2. Referring to (c) of FIG. 16, if the compensation value of '1' is added to image data that is to be supplied to three of the pixels in the dithering pattern, the gray value of the dithering pattern is increased by a gray value of 3/4.

In FRC using dithering patterns, to finely adjust luminance by a gray value of a decimal less than one, a compensation value is temporally dispersed as well as spatially dispersed by varying the number of pixels, to which the compensation value is added, in a dithering pattern that includes a plurality of pixels. For example, referring to (a) of FIG. 17, a dithering pattern may include a plurality of pixels arranged in a 2×2 matrix. In this case, if 1/4 dithering patterns which add a compensation value of '1' to one of the four pixels are applied during four frame periods, a gray value of the dithering pattern is increased by a gray value of 1/4 during the four frame periods. Referring to (b) of FIG. 17, if 1/2 dithering patterns which add the compensation value of '1' to two of the four pixels are applied during four frame periods, the gray value of the dithering pattern is increased by a gray value of 1/2 during the four frame periods. Referring to (c) of FIG. 17, if 3/4 dithering patterns which add the compensation value of '1' to three of the four pixels are applied during four frame periods, the gray value of the dithering pattern is increased by a gray value of 3/4 during the four frame periods.

The dithering method or the FRC method can be used to compensate for gray levels more precisely.

Figure 18:
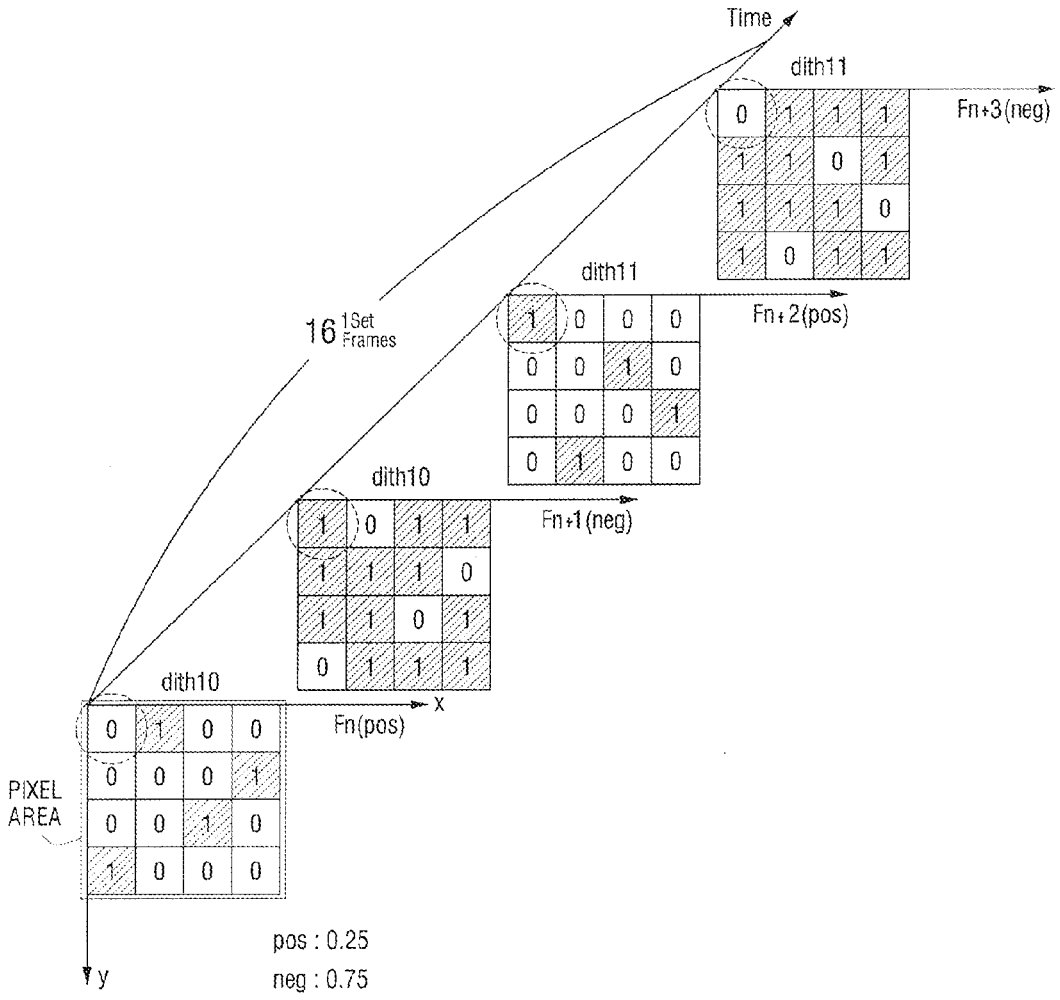
FIG. 18 is a conceptual diagram illustrating the operation of a dithering pattern determiner of the LCD of FIG. 3 according to an embodiment of the present invention.

FIG. 18 is a conceptual diagram illustrating the operation of the dithering pattern determiner 626 of the LCD of FIG. 3 according to an embodiment of the present invention.

Each dithering pattern dith illustrated in FIG. 18 is data expanded by 3 bits or 4 bits, and a dithering method will now be described using the dithering patterns dith. The liquid crystal panel 300 may include a plurality of pixel areas PA, each having 4×4 pixels. Each of the pixel areas PA may have a different dithering pattern dith, and the dithering pattern selector 624 may select a dithering pattern dith corresponding to a designated value DV and an eigenvalue EV. The dithering pattern selector 624 may determine the number of pixels that are to be weighted based on a set designated value DV and generate a dithering pattern dith based on an eigenvalue EV.

In FIG. 18, $n^{th}$ through $(n+3)^{th}$ frames Fn through Fn+3 are illustrated. Sixteen frames form one set, and a positive dithering pattern and a negative dithering pattern are alternately applied to each frame. That is, the $n^{th}$ frame Fn is a positive dithering pattern, the $(n+1)^{th}$ frame Fn+1 is a negative dithering pattern, the $(n+2)^{th}$ frame Fn+2 is a positive dithering pattern, and the $(n+3)^{th}$ frame Fn+3 is a negative dithering pattern.

The dithering pattern of the $n^{th}$ frame Fn corresponds to a 3-bit binary designated value of '010' and an eigenvalue of 'dith10.' The 3-bit binary designated value is determined by a ratio of the number of pixels, to which a weight of '1' is given, to the total number of pixels in a pixel area PA. Because the 3-bit binary designated value of '010' corresponds to '2' among eight natural numbers that can be expressed by a 3-bit binary number, a gray level increased by a ratio of +2/8, that is, a gray value of 1/4 can be expressed. In addition, because four out of sixteen pixels in the pixel area PA are weighted pixels, the dithering pattern dith10 of the $n^{th}$ frame Fn can express a gray level increased by a gray value of 1/4. Each designated value of 000, 001, 010, 011, . . . , 111 may include a plurality of eigenvalues of dith10, dith11, dith12, dith23, . . . , and a weight may or may not be given only to a specific position in a dithering pattern corresponding to each eigenvalue.

The dithering pattern of the $(n+1)^{th}$ frame Fn+1 corresponds to a 3-bit binary designated value of '110' and an eigenvalue of 'dith10.' Because the 3-bit binary designated value of '110' corresponds to '6' among eight natural numbers that can be expressed by a 3-bit binary number, a gray level increased by a ratio of +6/8, that is, a gray value of 3/4 can be expressed. In addition, because twelve out of the sixteen) pixels in the pixel area PA are weighted pixels, the dithering pattern dith10 of the $(n+1)^{th}$ frame Fn+1 can express a gray level increased by a gray value of 3/4.

Frames may have the same dithering pattern but may correspond to different designated values. For example, the $n^{th}$ frame Fn and the $(n+1)^{th}$ frame Fn+1 may have the same dithering pattern 'dith10' but may correspond to different designated values. Therefore, different patterns may be applied to the liquid crystal panel 300.

The dithering pattern of the $(n+2)^{th}$ frame Fn+2 corresponds to a 3-bit binary designated value of '010' and an eigenvalue of 'dith11.' Because the 3-bit binary designated value of '010' corresponds to '2' among eight natural numbers that can be expressed by a 3-bit binary number, a gray level increased by a ratio of +2/8, that is, a gray value of 1/4 can be expressed.

The dithering pattern of the $(n+3)^{th}$ frame Fn+3 corresponds to a 3-bit binary designated value of '110' and an eigenvalue of 'dith11.' Because the 3-bit binary designated value of '110' corresponds to '6' among eight natural numbers that can be expressed by a 3-bit binary number, a gray level increased by a ratio of +6/8, that is, a gray value of 3/4 can be expressed.

Figure 19:
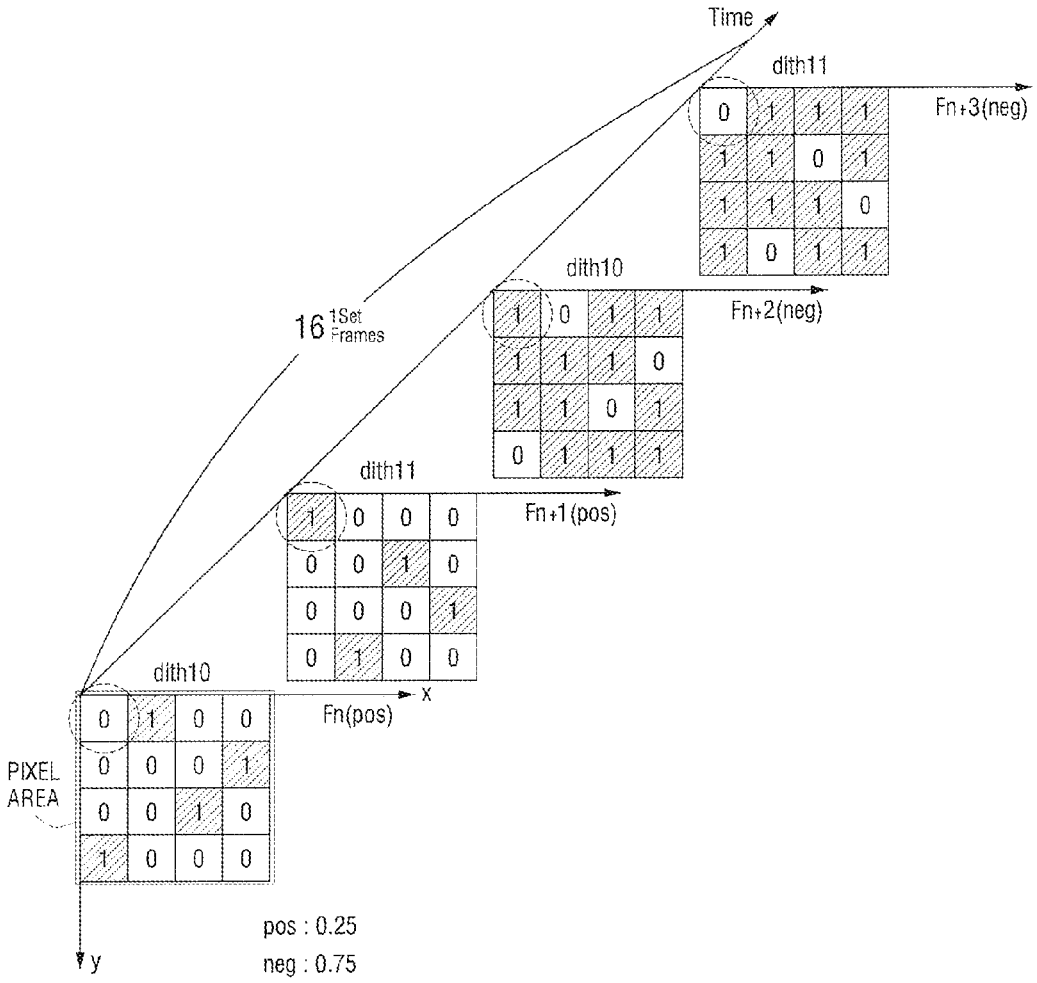
FIG. 19 is a diagram illustrating the operation of a dithering pattern determiner of an LCD according to another embodiment of the present invention.

FIG. 19 is a diagram illustrating the operation of a dithering pattern determiner 626 of an LCD according to another embodiment of the present invention.

The operation of the dithering pattern determiner 626 of FIG. 19 is similar to the operation of the dithering pattern determiner 626 of FIG. 18, and thus a redundant description thereof will be omitted. In FIG. 19, $n^{th}$ through $(n+3)^{th}$ frames are illustrated. Sixteen frames form one set, and a positive dithering pattern and a negative dithering pattern are alternately applied to every two frames. That is, dithering patterns corresponding to a 3-bit binary designated value of '010' and eigenvalues of 'dith10' and 'dith11' may be applied, and then dithering patterns corresponding to a 3-bit binary designated value of '110' and eigenvalues of 'dith10' and 'dith11' may be applied. Even if the dithering patterns of FIG. 19 are applied, a desired gray value can be obtained, and degradation caused by the application of voltages of the same polarity can be prevented or substantially prevented.

Figure 20:
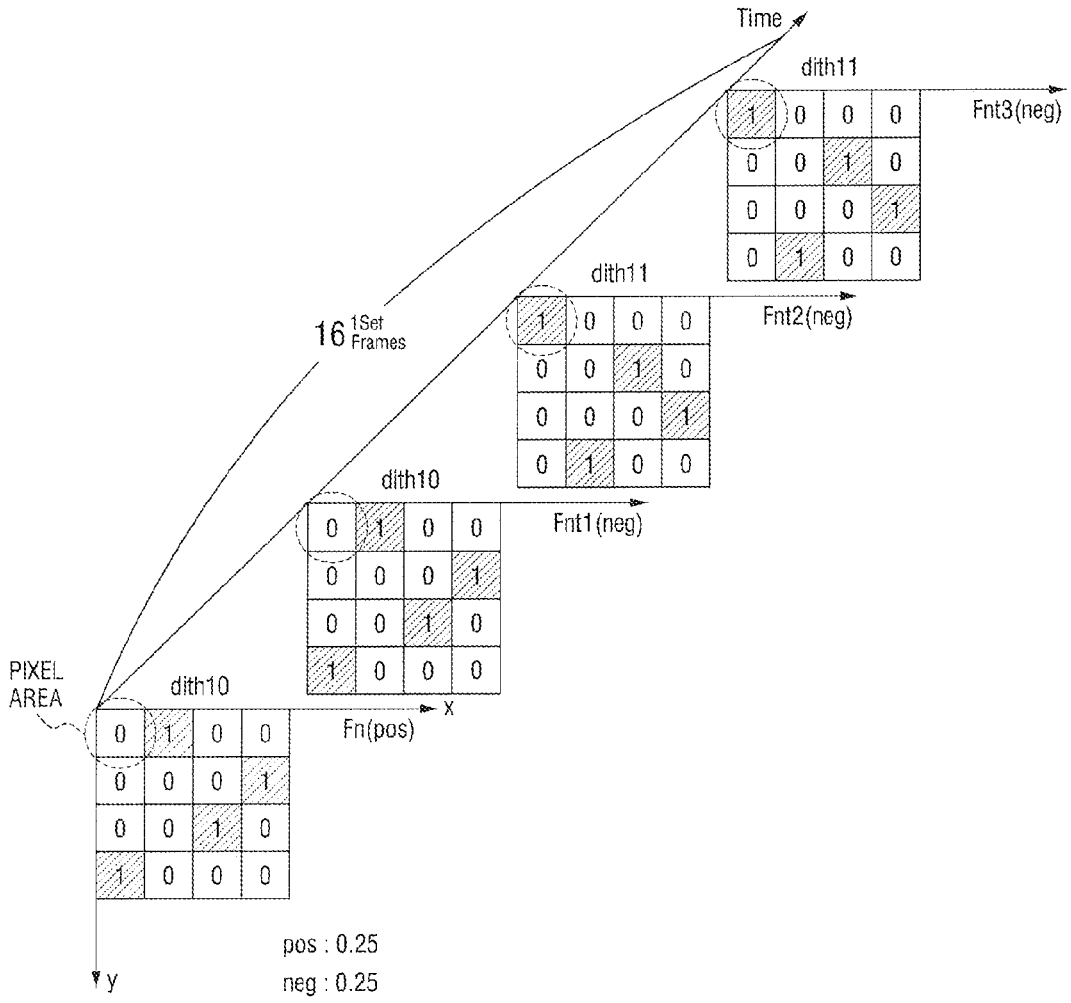
FIG. 20 is a conceptual diagram illustrating the operation of the LCD of FIG. 3 when dithering patterns corresponding to the same designated value and the same eigenvalue are applied.
Figure 21:
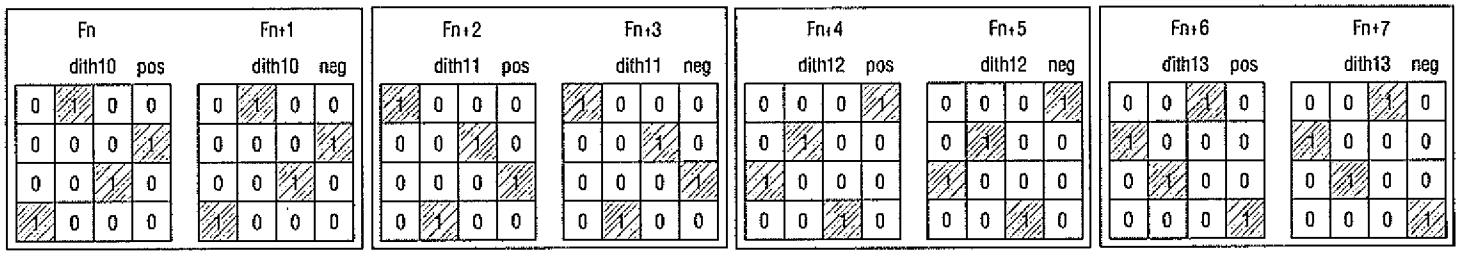
FIG. 21 is a conceptual diagram illustrating an image displayed on the LCD of FIG. 3 when the dithering patterns corresponding to the same designated value and the same eigenvalue are applied.

FIG. 20 is a conceptual diagram illustrating the operation of the LCD of FIG. 3 when dithering patterns corresponding to the same designated value and the same eigenvalue are applied. FIG. 21 is a conceptual diagram illustrating an image displayed on the LCD of FIG. 3 when the dithering patterns corresponding to the same designated value and the same eigenvalue are applied.

Referring to FIGS. 20 and 21, dithering patterns corresponding to the same designated value DV and the same eigenvalue EV but having different polarities are alternately applied to each frame. Data of a positive target image signal DAT_Cp and data of a negative target image signal DAT_Cn do not need to have different designated values DV which are set in order to express a certain gray level. However, if the data of the positive target image signal DAT_Cp and the data of the negative target image signal DAY_Cn have the same designated value DV, the same dithering pattern may be repeated for two frame periods as illustrated in FIG. 21, and this dithering pattern may be seen as stains.

For this reason, when target image data of different polarities have the same designated value DV, dithering patterns of the positive target image signal DAT_Cp and dithering patterns of the negative target image signal DAT_Cn may start to be applied from different dithering patterns.

Figure 22:
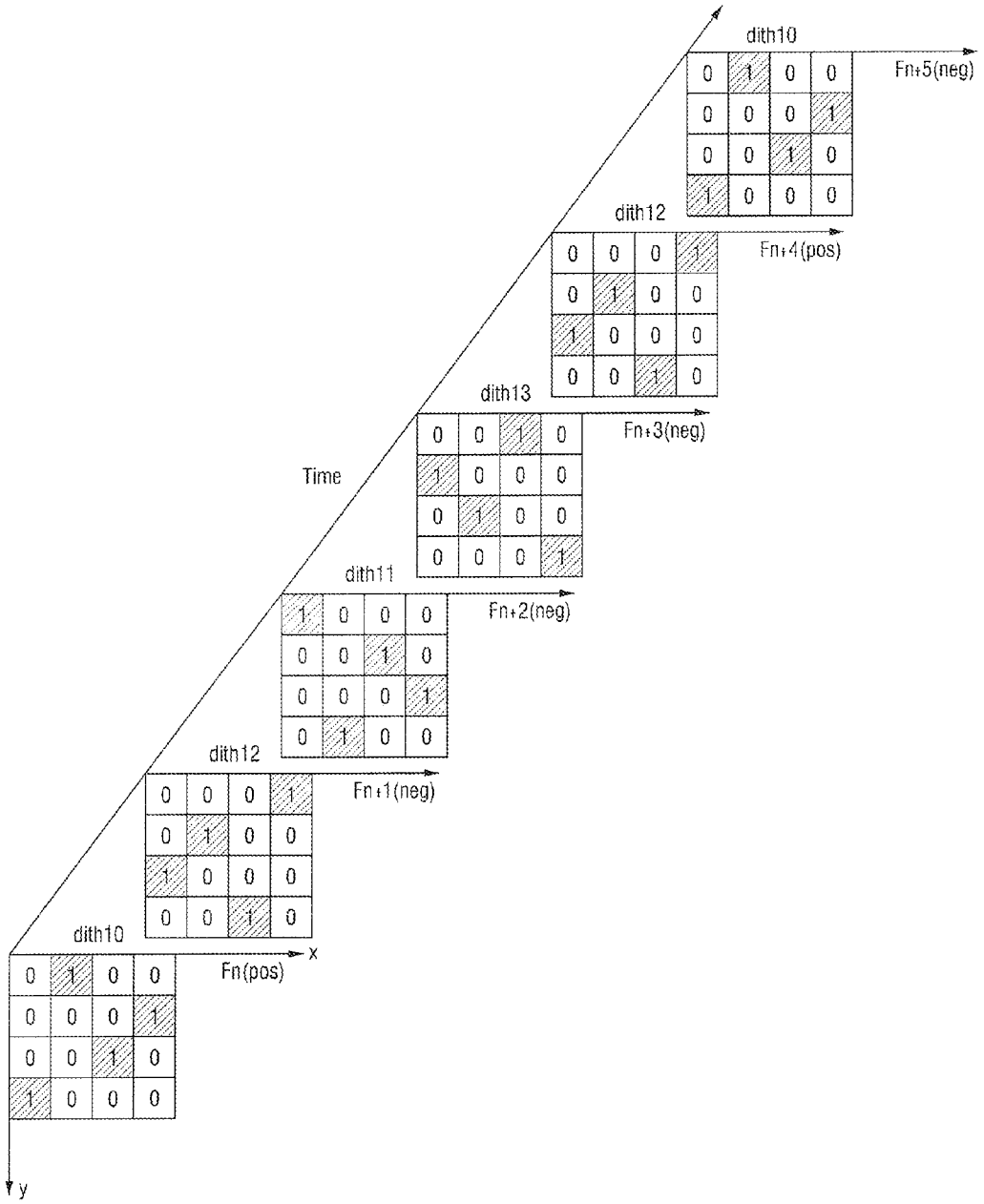
FIG. 22 is a conceptual diagram illustrating the operation of the LCD of FIG. 3 when dithering patterns start to be applied from a different dithering pattern for each polarity.
Figure 23:
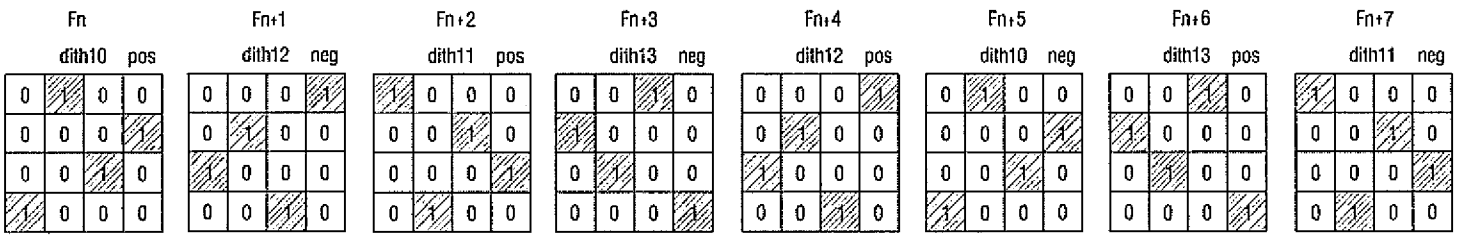
FIG. 23 is a conceptual diagram illustrating an image displayed on the LCD of FIG. 3 when the dithering patterns start to be applied from a different dithering pattern for each polarity.

FIG. 22 is a conceptual diagram illustrating the operation of the LCD of FIG. 3 when dithering patterns start to be applied from a different dithering pattern for each polarity. FIG. 23 is a conceptual diagram illustrating an image displayed on the LCD of FIG. 3 when the dithering patterns start to be applied from a different dithering pattern for each polarity In FIGS. 22 and 23, $n^{th}$ through $(n+5)^{th}$ frames Fn through Fn+5 are illustrated. A positive dithering pattern and a negative dithering pattern may be alternately applied to each frame. That is, the nth frame Fn is a positive dithering pattern, and the (n+1)th frame Fn+1 is a negative dithering pattern. In this way, polarity may be inverted every frame.

The dithering pattern of the nth frame Fn corresponds to a 3-bit binary designated value of '010' and an eigenvalue of 'dith10.' The dithering pattern of the (n+1)th frame Fn+1 corresponds to a 3-bit binary designated value of '010' and an eigenvalue of 'dith12.' The dithering pattern of the (n+2)th frame Fn+2 corresponds to a 3-bit binary designated value of '010' and an eigenvalue of 'dith11.' The dithering pattern of the (n+3)th frame Fn+3 corresponds to a 3-bit binary designated value of '010' and an eigenvalue of 'dith13.' The dithering pattern of the (n+4)th frame Fn+4 corresponds to a 3-bit binary designated value of '010' and an eigenvalue of 'dith12.' The dithering pattern of the (n+5)th frame Fn+5 corresponds to a 3-bit binary designated value of '010' and an eigenvalue of 'dith10.' That is, assuming that dithering patterns are applied in the order of the eigenvalues 'dith10', 'dith12' and 'dith13', positive dithering patterns may start to be applied from dith10, and negative dithering patterns may start to be applied from dith12. In this way, the positive and negative dithering patterns may be alternately applied to each frame.

When frames correspond to the same designated value DV, if dithering patterns start to be applied from a different dithering pattern (which corresponds to a different eigenvalue EV) for each polarity as described above, stains created by the repeated application of the same dithering pattern can be prevented or substantially prevented. The application order of the dithering patterns is not limited to the order in FIG. 23.

Figure 24:
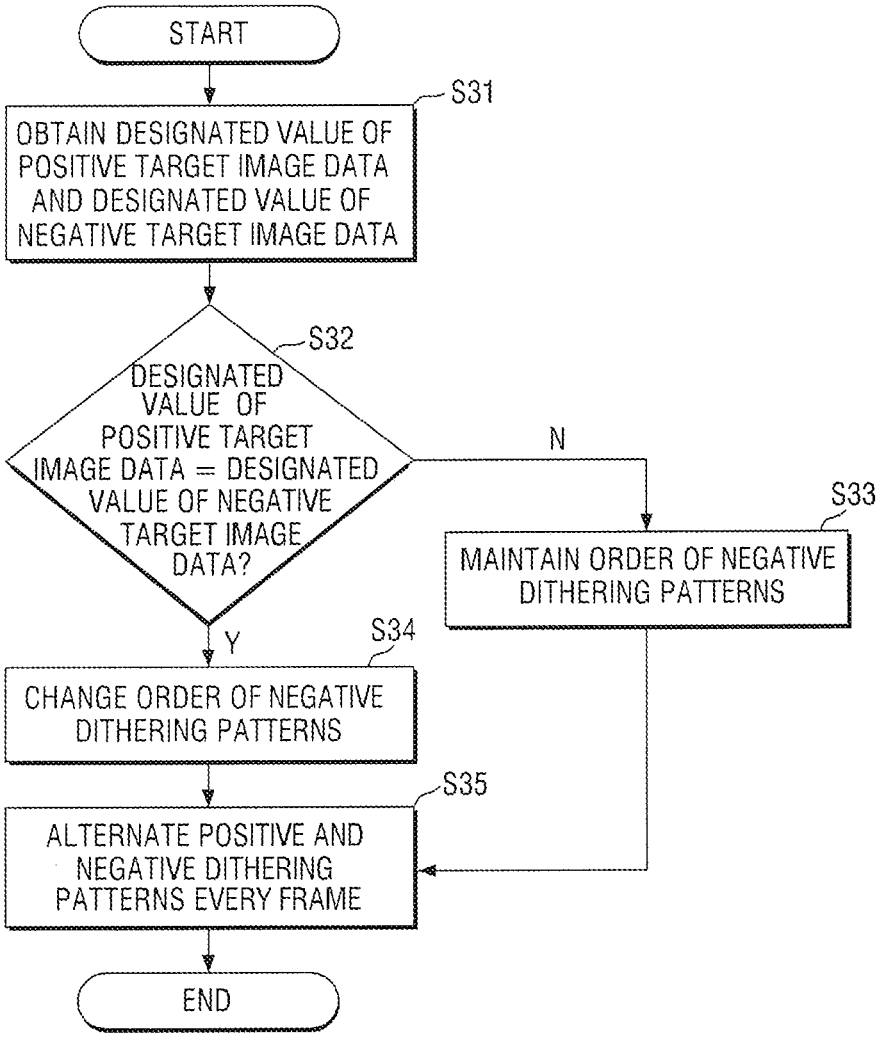
FIG. 24 is a flowchart illustrating a method of applying a dithering pattern whose polarity is inverted every frame according to an embodiment of the present invention.

FIG. 24 is a flowchart illustrating a method of applying a dithering pattern whose polarity is inverted every frame according to an embodiment of the present invention.

Referring to FIG. 24, the dithering unit 620 obtains a designated value DVp of a positive target image signal DAT_Cp and a designated value DVn of a negative target image signal DAT_Cn from the gray determination unit 610. The dithering pattern determiner 626 determines whether the designated value DVp of the positive target image signal DAT_Cp is equal to the designated value DVn of the negative target image signal DAT_Cn. If the designated values DVp and DVn are equal, the dithering pattern determiner 626 obtains a plurality of eigenvalues (dith10, dith11, dith12, . . . ) corresponding to the designated value DV from the second storage unit 634 and selects dithering patterns dith corresponding to the obtained eigenvalues EV. The dithering pattern determiner 626 determines the application order of the dithering patterns dith. The dithering patterns dith can be applied in the same order regardless of polarity. However, if the dithering patterns dith are applied in the same order regardless of polarity, they may start to be applied from different dithering patterns for different polarities. On the other hand, if the dithering patterns dith are applied in a different order for each polarity, they may start to be applied from the same dithering pattern regardless of polarity.

Thus, referring to FIG. 24, in block S31, the dithering unit 620 obtains a designated value of positive target image data and a designated value of negative target image data. In block S32, the dithering unit 620 determines whether or not the designated value of the positive target image data is equal to the designated value of the negative target image data. If the designated value of the positive target image data is not equal to the designated value of the negative target image data, in block S33, the dithering unit 620 maintains the order of the negative dithering patterns, and proceeds to block S35. If, however, the designated value of the positive target image data is equal to the designated value of the negative target image data, in block S34, the dithering unit 620 changes the order of the negative dithering patterns before proceeding to block S35. In block S35, the dithering unit 620 alternates the positive and negative dithering patterns for every frame.

Embodiments of the present invention may include at least one of the following characteristics.

That is, display quality may be improved by compensating for the effect of a kickback voltage at all gray levels by using dithering. For example, it may be possible to reduce the creation of an afterimage, a flicker, stains, etc. on the screen and reduce crosstalk occurring when a 3D image is formed using a shutter glass method.

However, the effects of the present invention are not restricted to those set forth herein. The above and other effects of the present invention will become more apparent to one of daily skill in the art to which the present invention pertains by referencing the claims.

While the present invention has been particularly shown and described with reference to example embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims and their equivalents, rather than the foregoing description, to indicate the scope of the invention.

What is claimed is:

1. A liquid crystal display (LCD) comprising:

a liquid crystal panel comprising a plurality of pixel areas, each of the pixel areas having a plurality of pixels; and a signal controller configured to receive an original image signal and to generate a target image signal corresponding to the original image signal by, for each gray level in the original image signal, subtracting a positive kickback voltage from a voltage of the original image signal having a positive polarity corresponding to the gray level, and adding a negative kickback voltage to a voltage of the original image signal having a negative polarity corresponding to the same gray level, wherein the signal controller comprises:

a dithering unit configured to generate a corrected image signal based on dithering patterns corresponding to the target image signal;

a driving unit configured to transmit the corrected image signal to the liquid crystal panel, the corrected image signal comprising a positive corrected image signal and a negative corrected image signal, wherein the driving unit is configured to alternately transmit the positive corrected image signal and the negative corrected image signal to the liquid crystal panel;

a storage unit configured to store the positive kickback voltage and the negative kickback voltage at each gray level, configured to store the dithering patterns, and comprising:

a first storage unit configured to store the positive kickback voltage and the negative kickback voltage at each gray level; and a second storage unit configured to store a target image signal, an expanded target image signal, a plurality of eigenvalues, and dithering patterns corresponding to the eigenvalues;

a gray determination unit configured to determine a gray level of the target image signal by analyzing a gray level of the original image signal; and the dithering unit configured to generate a corrected image signal by correcting a target image signal corresponding to each pixel area.

2. The LCD of claim 1, wherein the gray determination unit comprises:

a selector configured to select a gray level of each pixel area; and a compensator configured to generate the target image signal by compensating the original image signal corresponding to the selected gray level using the positive kickback voltage and the negative kickback voltage at each gray level received from the first storage unit.

3. The LCD of claim 1, wherein the dithering unit comprises:

an expander configured to expand data of the target image signal to generate an expanded target image signal;

a dithering pattern selector configured to select a dithering pattern corresponding to each pixel area; and a dithering processor configured to apply the selected dithering pattern to each pixel area.

4. The LCD of claim 3, wherein the expander is further configured to output an expanded target image signal by expanding the data of the target image signal by k bits.

5. The LCD of claim 4, wherein the second storage unit comprises a lookup table (LUT) mapped to data of the expanded target image signal which corresponds to the target image signal.

6. The LCD of claim 3, wherein the dithering pattern selector comprises:

a designated value generator configured to generate a designated value corresponding to the target image signal for each polarity provided by the gray determination unit; and a dithering pattern determiner configured to select a plurality of eigenvalues corresponding to the designated value for each polarity and to apply a dithering pattern corresponding to each of the selected eigenvalues to the pixel area.

7. The LCD of claim 6, wherein the designated value generator comprises:

a frame counter configured to count each frame;

a first counter configured to count a movement of a target pixel area in a first direction; and a second counter configured to count the movement of the target pixel area in a second direction, wherein the designated value generator is configured to generate the designated value using the frame counter, the first counter, and the second counter.

8. The LCD of claim 7, wherein the first direction is a row direction of the pixel areas, and the second direction is a column direction of the pixel areas.

9. The LCD of claim 6, wherein when a second frame begins after a first frame ends, a dithering pattern corresponding to a reference pixel area of the second frame is different from a dithering pattern corresponding to a reference pixel area of the first frame.

10. The LCD of claim 3, wherein the dithering processor comprises:

a reducing unit configured to generate a corrected image signal by reducing the data of the expanded target image signal by k bits; and the driving unit configured to transmit the corrected image signal to a data driver.

11. The LCD of claim 10, wherein the driving unit is configured to alternately transmit the positive corrected image signal and the negative corrected image signal to the liquid crystal panel in each frame.

12. The LCD of claim 10, wherein the driving unit is configured to alternately transmit data corresponding to the positive corrected image signal and data corresponding to the negative corrected image signal in every two frames.

13. A liquid crystal display (LCD) comprising:

a liquid crystal panel comprising a plurality of pixel areas, each of the pixel areas having a plurality of pixels; and a signal controller configured to receive an original image signal and to generate a target image signal corresponding to the original image signal by, for each gray level in the original image signal, subtracting a positive kickback voltage from a voltage of the original image signal having a positive polarity corresponding to the gray level, and adding a negative kickback voltage to a voltage of the original image signal having a negative polarity corresponding to the same gray level, wherein the signal controller is further configured to transmit a corrected image signal, whose polarity is inverted every frame, to the liquid crystal panel, and comprises:

a storage unit configured to store the positive kickback voltage and the negative kickback voltage at each gray level and dithering patterns;

a gray determination unit configured to determine a gray level of the target image signal by analyzing a gray level of the original image signal; and a dithering unit configured to generate a corrected image signal by correcting a target image signal corresponding to each pixel area, and comprising, a designated value generator configured to generate a designated value corresponding to the target image signal for each polarity provided by the gray determination unit; and a dithering pattern determiner configured to select a plurality of eigenvalues corresponding to the designated value for each polarity and to apply a dithering pattern corresponding to each of the selected eigenvalues to the pixel area.

14. The LCD of claim 13, wherein if the designated value for each polarity is equal, when a second frame begins after a first frame ends, a dithering pattern corresponding to a reference pixel area of the second frame is different from a dithering pattern corresponding to a reference pixel area of the first frame.

15. A liquid crystal display (LCD) comprising:

a liquid crystal panel comprising a plurality of pixel areas, each of the pixel areas having a plurality of pixels; and a signal controller configured to receive an original image signal and to generate a target image signal corresponding to the original image signal by, for each gray level in the original image signal, subtracting a positive kickback voltage from a voltage of the original image signal having a positive polarity corresponding to the gray level, and adding a negative kickback voltage to a voltage of the original image signal having a negative polarity corresponding to the same gray level, wherein the signal controller is configured to transmit a corrected image signal to the liquid crystal panel, wherein a polarity of the corrected image signal is inverted every two successive frames, the signal controller comprising:

a storage unit configured to store the positive kickback voltage and the negative kickback voltage at each gray level and dithering patterns;

a gray determination unit configured to determine a gray level of the target image signal by analyzing a gray level of the original image signal; and a dithering unit configured to generate a corrected image signal by correcting a target image signal corresponding to each pixel area, wherein the dithering unit comprises:

a designated value generator configured to generate a designated value corresponding to the target image signal for each polarity provided by the gray determination unit; and a dithering pattern determiner configured to select a plurality of eigenvalues corresponding to the designated value for each polarity and to apply a dithering pattern corresponding to each of the selected eigenvalues to the pixel area.

* * * * *